US011280348B2

(12) United States Patent
Dong et al.

(10) Patent No.: US 11,280,348 B2
(45) Date of Patent: Mar. 22, 2022

(54) HEAT EXCHANGE ASSEMBLY AND HEAT EXCHANGE DEVICE

(71) Applicant: GREE ELECTRIC APPLIANCES, INC. OF ZHUHAI, Guangdong (CN)

(72) Inventors: Mingzhu Dong, Guangdong (CN); Jianming Tan, Guangdong (CN); Guanghui Xia, Guangdong (CN); Bo Liang, Guangdong (CN); Xianlin Wang, Guangdong (CN); Xiaocheng Lai, Guangdong (CN); Junjie Liao, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 16/640,693

(22) PCT Filed: Feb. 8, 2018

(86) PCT No.: PCT/CN2018/075741

§ 371 (c)(1),
(2) Date: Feb. 20, 2020

(87) PCT Pub. No.: WO2019/127855

PCT Pub. Date: Jul. 4, 2019

(65) Prior Publication Data

US 2020/0355197 A1 Nov. 12, 2020

(30) Foreign Application Priority Data

Dec. 27, 2017 (CN) ..... 201711468487.6

(51) Int. Cl.

| | |
|---|---|
| ***F04D 29/28*** | (2006.01) |
| ***F04D 29/42*** | (2006.01) |
| ***F28D 1/02*** | (2006.01) |
| ***F28F 13/12*** | (2006.01) |

(52) U.S. Cl.

CPC ..... *F04D 29/281* (2013.01); *F04D 29/4226* (2013.01); *F28D 1/02* (2013.01); *F28F 13/12* (2013.01); *F28F 2250/08* (2013.01)

(58) Field of Classification Search

CPC ..... F04D 29/281; F04D 29/4226; F28D 1/02; F28D 15/00; F28D 20/00; F28D 1/00;
(Continued)

(56) References Cited

U.S. PATENT DOCUMENTS 6,050,773 A * 4/2000 Bushnell ..... F04D 29/444 415/53.1
10,088,176 B2 * 10/2018 Ikeda ..... F24F 13/30
(Continued)

FOREIGN PATENT DOCUMENTS

CN 203024288 U 6/2013
CN 203349410 U 12/2013
(Continued)

OTHER PUBLICATIONS

English machine translation of CN203907778U published on Oct. 29, 2014 (7 pages).
(Continued)

*Primary Examiner* — Justin M Jonaitis
(74) *Attorney, Agent, or Firm* — Stephen Y. Liu; James R. Gourley; Carstens & Cahoon, LLP

(57) ABSTRACT

A heat exchange assembly and a heat exchange device. The heat exchange assembly includes a heat exchanger and a fan; the heat exchanger and the fan are spaced apart, and the heat exchanger is located in an air intake direction or an air outgoing direction of the fan; the fan includes an air opening; a shortest distance H between the air opening of the fan facing the heat exchanger and the heat exchanger and a diameter D of an impeller of the fan should meet 2H/D>1.05. A problem in the prior art of increased air intake resistance caused by an improperly arranged distance between the heat exchanger and the fan is solved.

18 Claims, 5 Drawing Sheets

(58) Field of Classification Search
CPC ..... F28D 7/00; F28F 13/12; F28F 2250/08; F28F 1/00; F24F 1/00; F24F 3/00; F24F 5/0075; F24F 5/0089
USPC ..... 165/104.11, 148, 172, 48.1
See application file for complete search history.

(56) References Cited

U.S. PATENT DOCUMENTS

| | | | | |
|---|---|---|---|---|
| 2007/0256816 | A1* | 11/2007 | Higashida | F24F 1/0033 165/120 |
| 2017/0102007 | A1 | 4/2017 | Stauter et al. | |
| 2020/0277960 | A1* | 9/2020 | Nakai | F24F 1/0025 |

FOREIGN PATENT DOCUMENTS

| | | | |
|---|---|---|---|
| CN | 103574775 | A | 2/2014 |
| CN | 203907778 | U | 10/2014 |
| CN | 104456761 | A | 3/2015 |
| CN | 104697074 | A | 6/2015 |
| CN | 205918647 | U | 2/2017 |
| CN | 107036166 | A | 8/2017 |
| CN | 208012414 | U | 10/2018 |
| EP | 0367079 | A1 | 5/1990 |
| JP | H0486322 | A | 3/1992 |
| JP | 2000234766 | A | 8/2000 |
| JP | 2014009636 | A | 1/2014 |
| JP | 2016031059 | A | 3/2016 |

OTHER PUBLICATIONS

Extended European Search Report for European Application No. 18897833.2 dated Oct. 19, 2020 (6 pages).
International Search Report for Application No. PCT/CN2018/075741 dated Sep. 3, 2018 (3 pages).

* cited by examiner

HEAT EXCHANGE ASSEMBLY AND HEAT EXCHANGE DEVICE

CROSS-REFERENCE TO RELATED APPLICATION

This application is a U.S. National Stage of International Application No. PCT/CN2018/075741, filed on Feb. 8, 2018 and published as WO 2019/127855 on Jul. 4, 2019, which claims priority to Chinese Patent Application No. 201711468487.6, filed with the Chinese Patent Office on Dec. 27, 2017. Each application, publication, and patent listed in this paragraph are hereby incorporated by reference in their entireties.

TECHNICAL FIELD

The present disclosure relates to the technical field of heat exchange, and in particular to a heat exchange assembly and a heat exchange device.

BACKGROUND

For an arrangement of a distance between a heat exchanger and a fan in the prior art, an influence of a resistance caused by the distance is usually not considered. Since the increase of the air intake resistance caused by an improperly arranged distance will adversely affect the aerodynamic efficiency, air volume and noise and the like of the whole machine, it is necessary to optimize the arrangement of the distance.

Thus, the increase of the air intake resistance caused by the improperly arranged distance between the heat exchanger and the fan in the prior art, causes the problems of the drop of the aerodynamic efficiency and the rise of the noise of the whole machine.

SUMMARY

An objective of the present disclosure is to provide a heat exchange assembly and a heat exchange device, to solve the problem of the increase of the air intake resistance caused by the improperly arranged distance between the heat exchanger and the fan in the prior art.

In order to achieve the objective above, according to one aspect of the present disclosure, a heat exchange assembly is provided. The heat exchange assembly includes: a heat exchanger; a fan, where the heat exchanger and the fan are spaced apart, and the heat exchanger is located in an air intake direction or in an air outgoing direction of the fan; the fan has an air opening; the air opening faces the heat exchanger; and a shortest distance H between the air opening of the fan and the heat exchanger, and a diameter D of an impeller of the fan satisfy $$\frac{2H}{D} > 1.05.$$

Further, a projection of the air opening of the fan projected on the heat exchanger is located within an edge of the heat exchanger.

Further, a projection area S0 of the heat exchanger projected on a reference plane parallel to the air opening is greater than a projection area SP of the air opening of the fan projected on the reference plane.

Further, an air outgoing area S1 of the heat exchanger is greater than an air intake area S2 of the air opening of the fan.

Further, the air outgoing area S1 and the air intake area S2 of the air opening of the fan satisfy $$1 < \frac{S1}{S2} < 3.5.$$

Further, the heat exchanger is a curved plate-shaped structure, or a bent plate-shaped structure formed by attaching a plurality of plate-shaped sections sequentially.

Further, the heat exchanger is the bent plate-shaped structure formed by attaching the plurality of plate-shaped sections sequentially, and a plate section facing the air opening is arranged to be inclined to the air opening.

Further, the heat exchanger surrounds to form a heat exchanging region, and the air opening of the fan is located in the heat exchanging region.

Further, the heat exchanger is a plate-shaped structure, and the heat exchanger is parallel to the air opening, or the heat exchanger is arranged to be inclined to the air opening.

Further, the heat exchanger is one of a V-shaped heat exchanger, a W-shaped heat exchanger and a wave-shaped heat exchanger.

According to another aspect of the present disclosure, a heat exchange device is provided. The heat exchange device includes the heat exchange assembly above.

Further, the heat exchange device is an air conditioner.

According to the technical solutions of the present disclosure, the heat exchange assembly includes the heat exchanger and the fan. The heat exchanger and the fan are spaced apart, and the heat exchanger is located in an air intake direction or in an air outgoing direction of the fan. The fan has the air opening and the air opening faces the heat exchanger. The shortest distance H between the air opening of the fan and the heat exchanger and the diameter D of the impeller of the fan should satisfy $$\frac{2H}{D} > 1.05.$$

When the heat exchange assembly operates, the fan starts. Under the action of the negative pressure, the air is blown from the fan to the heat exchanger, or the air exchanges heat through the heat exchanger first, and after the heat is exchanged, the air flows through the air opening of the fan and is blown out of the fan. The air intake resistance presents a variation trend that the air intake resistance decreases sharply first and then gradually tends to be stable along with the increase of the distance between the heat exchanger and the fan, therefore, when the diameter D of the impeller and the shortest distance H between the heat exchanger and the air opening of the fan satisfy $$\frac{2H}{D} > 1.05,$$

it can be ensured mat the air intake resistance is smaller and tends to be stable, thereby preventing effectively the drop of the aerodynamic efficiency and the rise of the noise of the whole machine due to the increase of the air intake resistance.

BRIEF DESCRIPTION OF THE DRAWINGS

The accompanying drawings attached to the specification form a part of the disclosure and are intended to provide a further understanding of the present disclosure. The illustrative embodiments of the disclosure and the description thereof are used for explanations of the present disclosure, and do not constitute improper limitations of the present disclosure. In the accompanying drawings.

Figure 1:
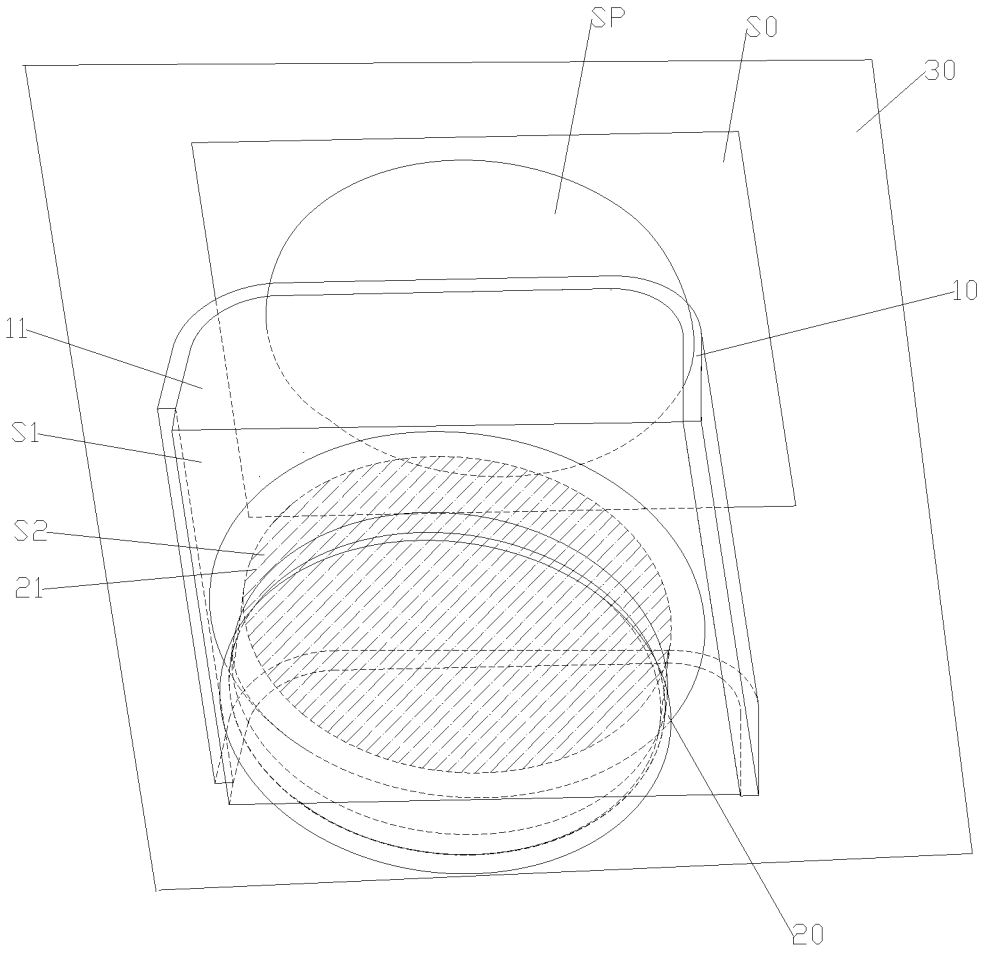
FIG. 1 is a schematic structural diagram illustrating a heat exchange assembly of a first embodiment of the present disclosure.

The above-mentioned figures include the following reference signs:

10. heat exchanger; 11. heat exchanging region; 20. fan; 21. air opening; 30. reference plane.

DETAILED DESCRIPTION OF THE EMBODIMENTS

It should be noted that the embodiments in the present disclosure and the features in the embodiments can be combined with each other if no conflicts occur. The disclosure will be described in detail below with reference to the accompanying drawings in combination with the embodiments.

It should be noted that, unless otherwise indicated, all technical and scientific terms used herein have the same meanings as commonly understood by the ordinary skilled in the art of the present disclosure.

In this disclosure, unless stated to the contrary, the orientation words such as "up, down, top, bottom" are usually used to refer to the orientations shown in the drawings, or to the component itself in the vertical, orthographic or gravity direction. Similarly, in order to facilitate the understanding and the description, "inner" and "outer" refer to "inner" and "outer" relative to the outline of each component itself. However, the orientation words are not given to limit the present disclosure.

In order to solve the problem that the increase of the air intake resistance caused by the improperly arranged distance between the heat exchanger 10 and the fan 20 in the prior art causes the drop of the aerodynamic efficiency and the rise of the noise of the whole machine, the present disclosure provides a heat exchange assembly and a heat exchange device. The heat exchange device has the heat exchange assembly described below.

Preferably, the heat exchange device is an air conditioner.

As shown in FIGS. 1 to 8, the heat exchange assembly includes a heat exchanger 10 and a fan 20. The heat exchanger 10 and the fan 20 are spaced apart, and the heat exchanger 10 is located in an air intake direction or in an air outgoing direction of the fan 20. The fan 20 is provided with an air opening 21, and the air opening 21 faces the heat exchanger 10. The shortest distance H between the air opening 21 of the fan 20 and the heat exchanger 10, and a diameter D of an impeller of the fan 20 satisfy $$\frac{2H}{D} > 1.05.$$

Specifically, when the heat exchange assembly operates, the fan 20 starts. Under the action of a negative pressure, the air is blown from the fan 20 to the heat exchanger 10; or the air exchanges heat through the heat exchanger 10 first, and after the heat is exchanged, the air flows through the air opening 21 of the fan 20 and is blown out of the fan 20. The air intake resistance ΔP (Pa) presents a variation trend that the air intake resistance ΔP decreases sharply first and then gradually tends to be stable along with the increase of the distance between the heat exchanger 10 and the fan 20, therefore, when the diameter D of the impeller and the shortest distance H between the heat exchanger 10 and the air opening 21 of the fan 20 satisfy $$\frac{2H}{D} > 1.05,$$

it can be ensured that the air intake resistance is smaller and tends to be stable, thereby preventing effectively the drop of the aerodynamic efficiency and the rise of the noise of the whole machine due to the increase of the air intake resistance.

It should be noted that when an air intake opening of the fan faces the heat exchanger 10, where the air opening 21 is the air intake opening, the air flows through the heat exchanger 10 first, and then flows into the fan 20. When an air outgoing opening of the fan 20 faces the heat exchanger 10, where the air opening 21 is the air outgoing opening, the air flows through the fan 20 first and then is blown to the heat exchanger 10.

The following description will be made by taking the air opening 21 as the air intake opening as an example.

In order to ensure the heat exchange effect of the heat exchange assembly and the starting efficiency of the whole machine, in the present disclosure, the projection of the air opening 21 of the fan 20 projected on the heat exchanger 10 is located within an edge of the heat exchanger 10. In such a way it can be ensured that, before entering the fan 20 through the air opening 21, all air exchanges heat through the heat exchanger 10, thereby ensuring the heat exchange efficiency of the heat exchange assembly.

Optionally, the fan 20 is a cross-flow fan or a centrifugal fan.

The following description will be illustrated via five embodiments according to different specific structures of the heat exchanger 10.

First Embodiment

As shown in FIGS. 1 to 5, in this embodiment, the heat exchanger 10 is a bent plate-shaped structure formed by attaching a plurality of plate-shaped sections sequentially, and an air outgoing area S1 of the heat exchanger 10 is greater than an air intake area S2 of the air opening 21 of the fan 20.

Figure 2:
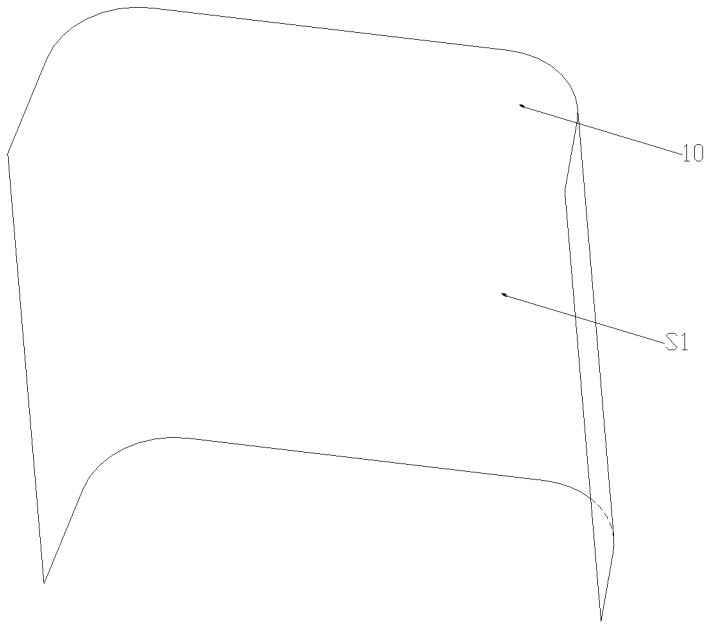
FIG. 2 is a schematic diagram illustrating an air outgoing area S1 of the heat exchanger in FIG. 1.

It should be noted that the air outgoing area S1 of the heat exchanger 10 refers to the whole area of the air blow after the air flows through the heat exchanger 10. In FIG. 2, S1 refers to the whole surface area of a side of the heat exchanger 10, and the air flows out of the side of the heat exchanger.

Specifically, the heat exchanger 10 is formed by attaching three plate-shaped sections sequentially to be a U-shaped heat exchanger. Moreover, the plate section located in the middle is arranged to face the air opening 21 of the fan 20 directly. Of course, in other embodiments, for example, in the fifth embodiment, the middle plate section can be arranged to be inclined to the air opening 21.

Optionally, the air outgoing area S1 of the heat exchanger 10 and the air intake area S2 of the air opening 21 of the fan 20 satisfy $$1 < \frac{S1}{S2} < 3.5.$$

It should be noted that the ratio of S1/S2 should be controlled appropriately to prevent the ratio of S1/S2 from being excessive small or excessive large. When the ratio of S1/S2 is excessive small, the size of the heat exchanger 10 cannot meet the requirements for the heat exchange. When the ratio of S1/S2 is excessive large, a larger air intake resistance ΔP will be produced.

As shown in FIG. 1, a projection area S0 of the heat exchanger 10 projected on a reference plane 30 parallel to the air opening 21 is greater than a projection area SP of the air opening 21 of the fan 20 projected on the reference plane 30. Through the above arrangement, the area of the heat exchanger 10 can be large enough to ensure that, before entering the fan 20 through the air opening 21, the air all exchanges heat through the heat exchanger 10, thereby ensuring the heat exchange efficiency of the heat exchange assembly.

Specifically, in FIGS. 1 to 4, a portion of the heat exchanger 10 faces the air opening 21 and is parallel to the air opening 21, therefore the portion, the reference plane 30, and the plane in which the air opening 21 is disposed, are parallel to each other. In this way, the projection area described above is the structural area corresponding to the structure.

Figure 3:
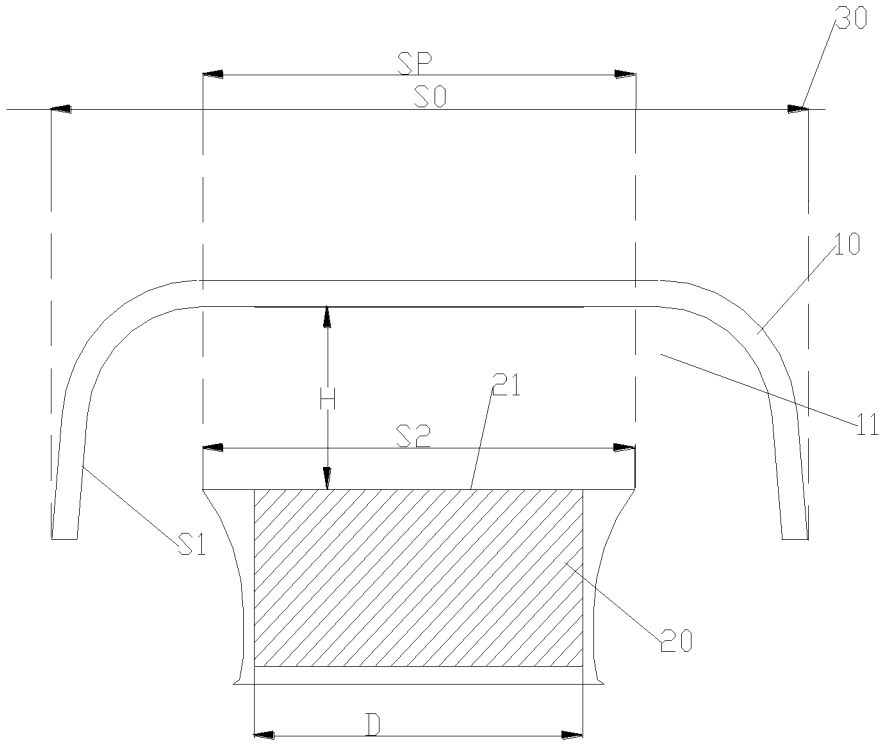
FIG. 3 shows a top view of the heat exchange assembly in FIG. 1.
Figure 4:
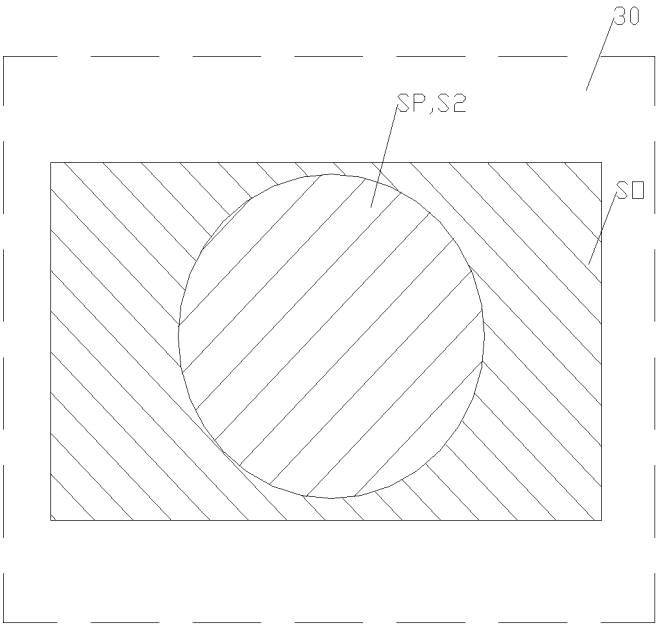
FIG. 4 shows an orthographic projection diagram of the heat exchange assembly in FIG. 1.

As shown in FIGS. 1 to 3, the heat exchanger 10 surrounds to form a heat exchanging region 11, and the air opening 21 of the fan 20 is located in the heat exchanging region 11. Since the air opening 21 is located in the heat exchanging region 11, after exchanging heat through the heat exchanger 10, the air can enter the fan 20 smoothly, thereby ensuring the heat exchange efficiency of the heat exchange assembly.

Figure 5:
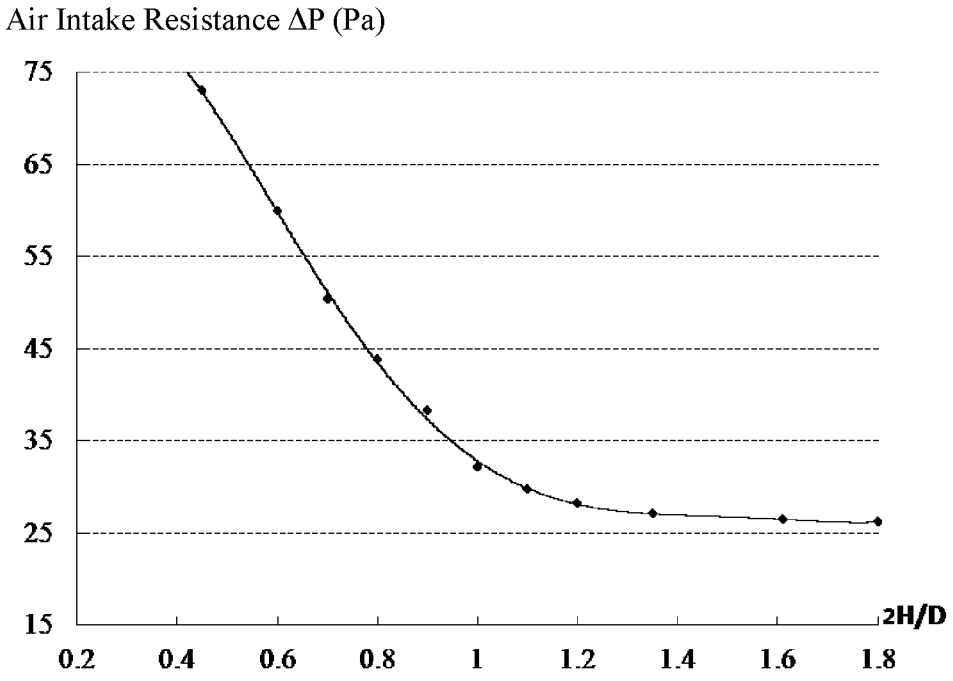
FIG. 5 shows a relationship between an air intake resistance and a ratio of a shortest distance between the heat exchanger and an air opening of a fan to a diameter of an impeller of the heat exchange assembly in FIG. 1.

As shown in FIG. 5, in this embodiment, while the ratio of the shortest distance H between the heat exchanger 10 and the air opening 21 of the fan 20 to the diameter D of the impeller of the fan 20 varies, the air intake resistance ΔP varies as well. The specific variation relationship is that: the air intake resistance ΔP (Pa) presents a variation trend that the air intake resistance ΔP decreases sharply first and then gradually tends to be stable along with the increase of the distance between the heat exchanger 10 and the fan 20.

Thus, apart from the ratio of S1/S2, the ratio of the shortest distance H between the heat exchanger 10 and the air opening 21 of the fan 20 to the diameter D of the impeller of the fan 20 has a larger influence on the air intake resistance ΔP.

Second Embodiment

Distinguished from the first embodiment, the heat exchanger 10 has a different structure.

Figure 6:
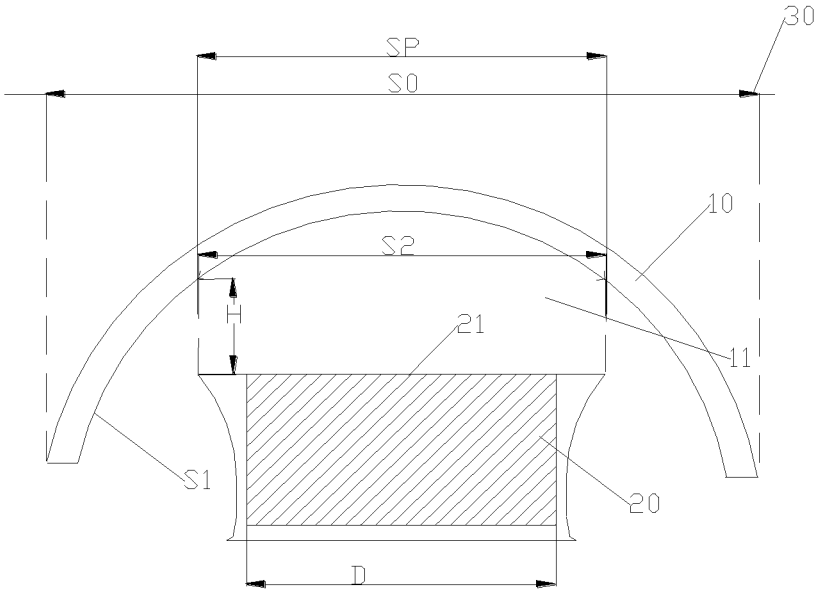
FIG. 6 is a schematic structural diagram illustrating the heat exchange assembly of a second embodiment of the present disclosure.

In this embodiment, as shown in FIG. 6, the heat exchanger 10 is a curved plate-shaped structure.

Likewise, the heat exchanger 10 can surround to form the heat exchanging region 11. The air opening 21 of the fan 20 is located in the heat exchanging region 11. Of course, the air opening 21 may also not be located in the heat exchanging region 11.

Compared with the embodiment of FIG. 1, the projection area S0 of the heat exchanger 10 projected on the reference plane 30 is not changed, and the projection area SP of the air opening 21 of the fan 20 projected on the reference plane 30 is also consistent with that shown in FIG. 1.

Compared with the heat exchanger 10 in the first embodiment, the heat exchange area of the heat exchanger 10 in this embodiment is larger, and the heat exchange effect per area unit is better.

Third Embodiment

Distinguished from the first embodiment, the heat exchanger 10 has a different structure.

Figure 7:
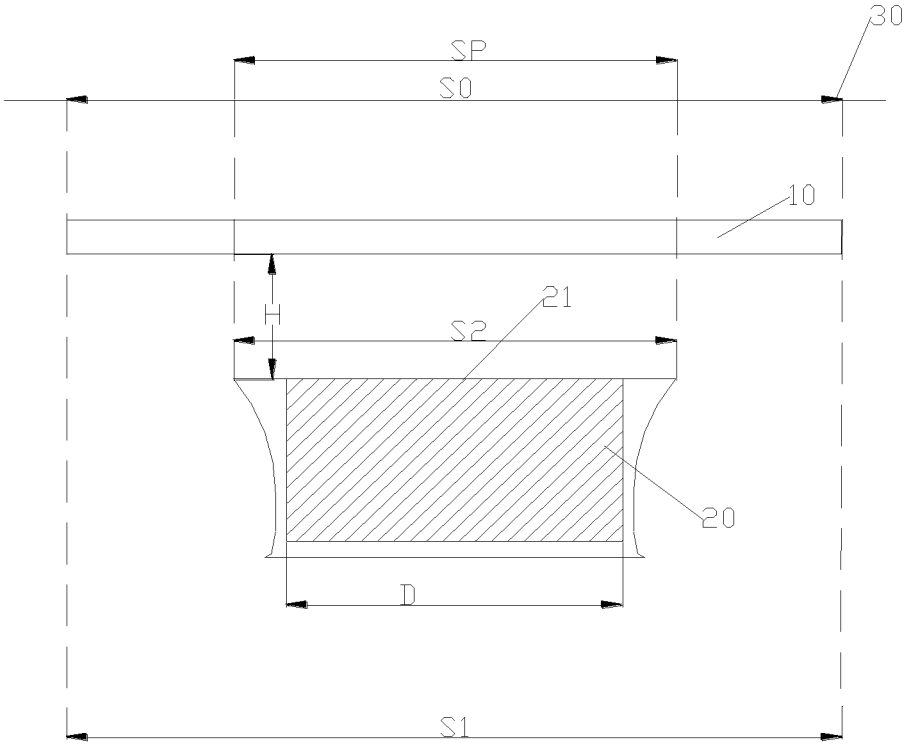
FIG. 7 is a schematic structural diagram illustrating the heat exchange assembly of a third embodiment of the present disclosure.

In this embodiment, as shown in FIG. 7, the heat exchanger 10 is a plate-shaped structure, and the heat exchanger 10 is configured to be parallel to the air opening 21.

In this embodiment, the heat exchanger 10 cannot surround to form the heat exchanging region 11, and is merely arranged at the air intake side of the fan 20.

Thus, in this embodiment, the air intake area of the heat exchanger 10 is equal to the air outgoing area. In order to ensure the consistence with other embodiments, in FIG. 7, S1 is still used to represent the air outgoing area of the heat exchanger 10.

Compared with the embodiment of FIG. 1, the projection area S0 of the heat exchanger 10 projected on the reference plane 30 is not changed, and the projection area SP of the air opening 21 of the fan 20 projected on the reference plane 30 is also consistent with that shown in FIG. 1.

Compared with the heat exchanger 10 in the first embodiment, the heat exchanger 10 in this embodiment has a more simple structure.

Fourth Embodiment

Distinguished from the third embodiment, the heat exchanger 10 has a different structure.

Figure 8:
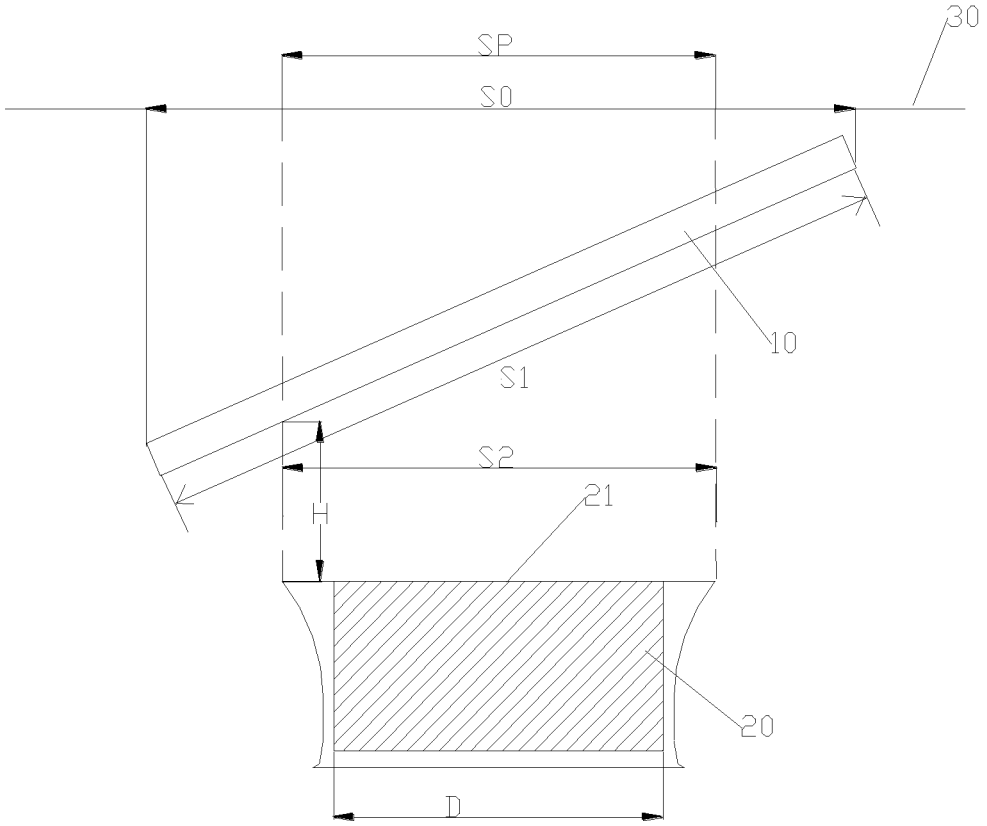
FIG. 8 is a schematic structural diagram illustrating the heat exchange assembly of a fourth embodiment of the present disclosure.

In this embodiment, as shown in FIG. 8, the heat exchanger 10 is a plate-shaped structure, and the heat exchanger 10 is configured to be inclined to the air opening 21.

In this embodiment, the heat exchanger 10 cannot surround to form the heat exchanging region 11, and is merely arranged at the air intake side of the fan 20.

Thus, in this embodiment, the air intake area of the heat exchanger 10 is equal to the air outgoing area of the heat exchanger 10. In order to ensure the consistence with the other embodiments, in FIG. 8, S1 is still used to represent the air outgoing area of the heat exchanger 10.

Compared with the embodiment in FIG. 1, the projection area S0 of the heat exchanger 10 projected on the reference plane 30 is less than the air intake area of the heat exchanger 10 itself. Moreover, the projection area SP of the air opening 21 of the fan 20 projected on the reference plane 30 is consistent with that shown in FIG. 1.

Compared with the heat exchanger 10 in the first embodiment, the heat exchanger 10 in this embodiment has a more simple structure.

Fifth Embodiment

Distinguished from the first embodiment, the plate-shaped section facing the air opening 21 is configured to be inclined to the air opening 21. The specific configuration can be referred to the description for FIG. 8.

Compared with the heat exchanger 10 in the first embodiment, the heat exchange area of the heat exchanger 10 in this embodiment is larger, and the heat exchange effect per area unit is better.

Of course, besides the heat exchangers 10 shown in the figures, heat exchangers of various shapes, such as a V-shaped heat exchanger, a W-shaped heat exchanger, a wave-shaped heat exchanger and the like, are likewise applicable for the above-mentioned arrangement.

Apparently, the embodiments described above are merely part of the embodiments of the present disclosure, rather than all the embodiments. Based on the embodiments of the present disclosure, all other embodiments obtained by those skilled in the art without creative efforts shall fall within the protection scope of the present disclosure.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

It should be noted that the terms "first", "second", and the like in the description, claims and drawings of the present disclosure are used to distinguish similar objects, and are not necessarily used to describe a specific order or order. It should be appreciated that such terms can be interchangeable if appropriate, so that the embodiments of the disclosure described herein can be implemented, for example, in an order other than those illustrated or described herein.

The above descriptions are merely the preferred embodiments of the present disclosure, and are not intended to limit the present disclosure. For those skilled in the art, various modifications and changes can be made for the present disclosure. Any modifications, equivalent substitutions, improvements, etc., made within the spirits and the principles of the present disclosure are included within the scope of the present disclosure.

What is claimed is:

1. A heat exchange assembly, comprising:

a heat exchanger; and a fan;

wherein the heat exchanger and the fan are spaced apart, and the heat exchanger is located in an air intake direction or in an air outgoing direction of the fan; the fan has an air opening; the air opening faces the heat exchanger; and H denotes a shortest distance between the air opening of the fan and the heat exchanger, D denotes a diameter of an impeller of the fan, and H and D satisfy $$\frac{2H}{D} > 1.05,$$

and wherein S1 denotes an air outgoing area of the heat exchanger, S2 denotes an air intake area of the air opening of the fan, and S1 is greater than S2.

2. The heat exchange assembly of claim 1, wherein a projection of the air opening of the fan projected on the heat exchanger is located within an edge of the heat exchanger.

3. The heat exchange assembly of claim 1, wherein a projection area S0 of the heat exchanger projected on a reference plane parallel to the air opening is greater than a projection area SP of the air opening of the fan projected on the reference plane.

4. The heat exchange assembly of claim 1, wherein S1 and S2 satisfy $$1 < \frac{S1}{S2} < 3.5.$$

5. The heat exchange assembly of claim 1, wherein, the heat exchanger is a curved plate-shaped structure, or a bent plate-shaped structure formed by attaching a plurality of plate-shaped sections sequentially.

6. The heat exchange assembly of claim 5, wherein, the heat exchanger is the bent plate-shaped structure formed by attaching the plurality of plate-shaped sections sequentially, and a plate section facing the air opening is arranged to be inclined to the air opening.

7. The heat exchange assembly of claim 5, wherein, the heat exchanger surrounds to form a heat exchanging region, and the air opening of the fan is located in the heat exchanging region.

8. The heat exchange assembly of claim 1, wherein, the heat exchanger is a plate-shaped structure; and the heat exchanger is parallel to the air opening, or the heat exchanger is arranged to be inclined to the air opening.

9. The heat exchange assembly of claim 1, wherein the heat exchanger is one of a V-shaped heat exchanger, a W-shaped heat exchanger and a wave-shaped heat exchanger.

10. A heat exchange device, comprising the heat exchange assembly of claim 1.

11. The heat exchange device of claim 10, wherein the heat exchange device is an air conditioner.

12. The heat exchange assembly of claim 5, wherein, a projection of the air opening of the fan projected on the heat exchanger is located within an edge of the heat exchanger.

13. The heat exchange assembly of claim 5, wherein, a projection area S0 of the heat exchanger projected on a reference plane parallel to the air opening is greater than a projection area SP of the air opening of the fan projected on the reference plane.

14. The heat exchange assembly of claim 8, wherein, a projection of the air opening of the fan projected on the heat exchanger is located within an edge of the heat exchanger.

15. The heat exchange assembly of claim 8, wherein, a projection area S0 of the heat exchanger projected on a reference plane parallel to the air opening is greater than a projection area SP of the air opening of the fan projected on the reference plane.

16. The heat exchange assembly of claim 5, wherein, the heat exchanger is the bent plate-shaped structure formed by attaching the plurality of plate-shaped sections sequentially, and a plate section facing the air opening is parallel to the air opening.

17. The heat exchange assembly of claim 1, wherein the heat exchanger is formed by attaching three plate-shaped sections sequentially to be a U-shaped heat exchanger.

18. The heat exchange assembly of claim 8, wherein, the heat exchanger is the plate-shaped structure; the heat exchanger is parallel to the air opening; and the heat exchanger is merely arranged at the air intake side of the fan.

* * * * *